United States Patent [19]

Hosoi et al.

[11] Patent Number: 4,858,581

[45] Date of Patent: Aug. 22, 1989

[54] AIR-FUEL RATIO FEEDBACK CONTROL METHOD FOR INTERNAL COMBUSTION ENGINES

[75] Inventors: Shuichi Hosoi; Sachito Fujimoto, both of Wako, Japan

[73] Assignee: Honda Giken Kogyo Kabushiki Kaisha, Japan

[21] Appl. No.: 164,796

[22] Filed: Mar. 7, 1988

[30] Foreign Application Priority Data

Mar. 31, 1987 [JP] Japan ..... 62-78337

[51] Int. Cl.[4] ..... F02M 51/00

[52] U.S. Cl. ..... 123/489; 123/492

[58] Field of Search ..... 123/489, 492, 493, 440, 123/430, 487; 73/23

[56] References Cited

U.S. PATENT DOCUMENTS

| | | | |
|---|---|---|---|
| 4,677,559 | 6/1987 | Van Brück | 123/489 |
| 4,744,345 | 5/1988 | Yamato et al. | 123/489 |
| 4,751,906 | 6/1988 | Yataba et al. | 123/489 |
| 4,751,907 | 6/1988 | Yamamoto et al. | 123/489 |
| 4,751,909 | 6/1988 | Atdoe | 123/489 |
| 4,753,208 | 6/1988 | Yamato et al. | 123/489 |

*Primary Examiner*—Raymond A. Nelli
*Attorney, Agent, or Firm*—Charles S. McGuire

[57] ABSTRACT

A method of controlling the air-fuel ratio of a mixture being supplied to an internal combustion engine, in a feedback manner responsive to output from an $O_2$ sensor arranged in the engine exhaust system for sensing the concentration of a component in exhaust gases from the engine to produce as the output a normally fluctuating output signal indicative of the concentration. The air-fuel ratio is controlled to a desired value by means of at least one of proportional control applying a first correction value to correct the air-fuel ratio when the output signal changes from a rich side to a lean side or vice versa with respect to a predetermined reference value, and integral control applying a second correction value to correct the air-fuel ratio whenever a predetermined period of time elapses so long as the output signal remains on the lean side or on the rich side with respect to the predetermined reference value. At least one of the first and second correction values is set to a smaller first value as load on the engine is higher, and the set at least one correction value is applied to correction of the air-fuel ratio in a direction of enriching the mixture.

6 Claims, 6 Drawing Sheets

| FIG. 3A | FIG. 3B |
|---|---|

AIR-FUEL RATIO FEEDBACK CONTROL METHOD FOR INTERNAL COMBUSTION ENGINES

BACKGROUND OF THE INVENTION

This invention relates to a method of controlling the air-fuel ratio of a mixture being supplied to internal combustion engines, and more particularly to a method of this kind which is able to enhance the conversion efficienty of an exhaust gas-purifying device arranged in the engine exhaust system and hence improve the exhaust emission characteristics of the engine.

Internal combustion engines in general are equipped with exhaust gas-purifying devices arranged in the engine exhaust system to reduce the amounts of toxic components in exhaust gases emitted from the engine to thereby improve the exhaust emission characteristics of the engine. As such exhaust as-purifying devices there are generally employed three-way catalytic converters which operate to reduce all CO, HC, and NOx in the exhaust gases. In order to obtain the best conversion efficiency of such three-way catalytic converters, the air-fuel ratio of a mixture being supplied to the engine is controlled to a stoichiometric ratio in response to output from an exhaust gas sensor which is arranged in the engine exhaust system to detect the concentration of a specific component, e.g. oxygen, in the exhaust gases.

Conventional three-way catalytic converters have the tendency to achieve higher rates of reduction of CO and HC when the air-fuel ratio is leaner than the stoichiometric ratio, and a higher rate of reduction of NOx when the air-fuel ratio is richer than the stoichiometric ratio, respectively. Therefore, in order to obtain the best conversion efficiency, the air-fuel ratio has to be controlled to the stoichiometric ratio that is a value of compromise at which all the rates of reduction of CO, HC and NOx can be sufficient.

As one of conventional air-fuel ratio feedback control methods, a method is known e.g. from Japanese Provisional Patent Publication (Kokai) No. 61-272432 assigned to the assignee of the present application, which comprises comparing an output value indicative of sensed oxygen concentration in engine exhaust gases from an oxygen sensor arranged in the engine exhaust system with a predetermined reference value, and effecting feedback control of the air-fuel ratio to a target value (e.g. stoichiometric ratio) in such a manner that proportional control is applied by increasing or decreasing the air-fuel ratio by a first correction value whenever the output value from the oxygen sensor changes from a rich side to a lean side or vice versa with respect to the predetermined reference value, and integral control is applied by increasing or decreasing the air-fuel ratio by a second correction value upon the lapse of a predetermined period of time so long as the sensor output value remains on the rich side or on the lean side with respect to the predetermined reference value.

However, the above known method still remains to be improved if applied when the vehicle equipped with the engine is cruising at a high speed. That is, according to the known method, the first correction value is set to a smaller value at the time of correcting the air-fuel ratio to the rich side, as compared with the time of correcting the air-fuel ratio to the lean side, when the engine is in a high load condition such as engine acceleration, to thereby prevent increase in the amounts of CO and HC in the exhaust gases as caused by enriching of the mixture when the engine is in the high load condition. As a result, when the vehicle is cruising at a high speed where the engine load is high, the first correction value is thus set to a smaller value by which the air-fuel ratio is corrected toward the rich side. This, however, results in the air-fuel ratio becoming lean, making it difficult to reduce the amount of NOx to a sufficient degree.

SUMMARY OF THE INVENTION

It is therefore the object of the invention to provide an air-fuel ratio feedback control method for internal combustion engines, which is capable of reducing the amounts of CO and HC in the exhaust gases to sufficient degrees during high engine load conditions such as engine acceleration, and also capable of reducing the amount of NOx in the exhaust gases to a sufficient degree during high speed/high load running or high speed cruising of the vehicle.

To attain the above object, the present invention provides a method of controlling the air-fuel ratio of a mixture being supplied to an internal combustion engine having an exhaust system, in a feedback manner responsive to output from sensing means arranged in the exhaust system for sensing the concentration of a component in exhaust gases from the engine to produce as the output a normally fluctuating output signal indicative of the concentration of the component, the method including:

comparing the value of the output signal with a predetermined reference value; and controlling the air-fuel ratio of the mixture to a desired value by means of at least one of proportional control applying a first correction value to correct the air-fuel ratio when the output signal changes from a rich side to a lean side or vice versa with respect to the predetermined reference value, and integral control applying a second correction value to correct the air-fuel ratio whenever a predetermined period of time elapses so long as the output signal remains on the lean side or on the rich side with respect to the predetermine reference value.

The method according to the invention is characterized by comprising the following steps:

(a) sensing load on the engine;

(b) setting at least one of the first correction value and the second correction value to a smaller first value as the sensed load on the engine is higher, and applying the set at least one correction value to correction of the air-fuel ratio of the mixture in a direction of enriching the mixture; and (c) setting the at least one correction value to a second value larger than the first value when the engine is operating in a steady condition where the sensed load on the engine is higher than a predetermined value, and applying the at least one correction value set to the second value to correction of the air-fuel ratio of the mixture in the direction of enriching the mixture.

It is determined that the engine is operating in the above steady condition when the engine is continually operating over a predetermined period of time in a condition where the sensed load on the engine is higher than the predetermined value and the rotational speed of the engine is higher than a predetermined value.

The above and other objects, features, and advantages of the invention will be more apparent from the ensuing detailed description taken in conjunction with the accompanying drawings.

DETAILED DESCRIPTION

The method of the invention will now be described in detail with reference to the drawings showing embodiments thereof.

Figure 1:
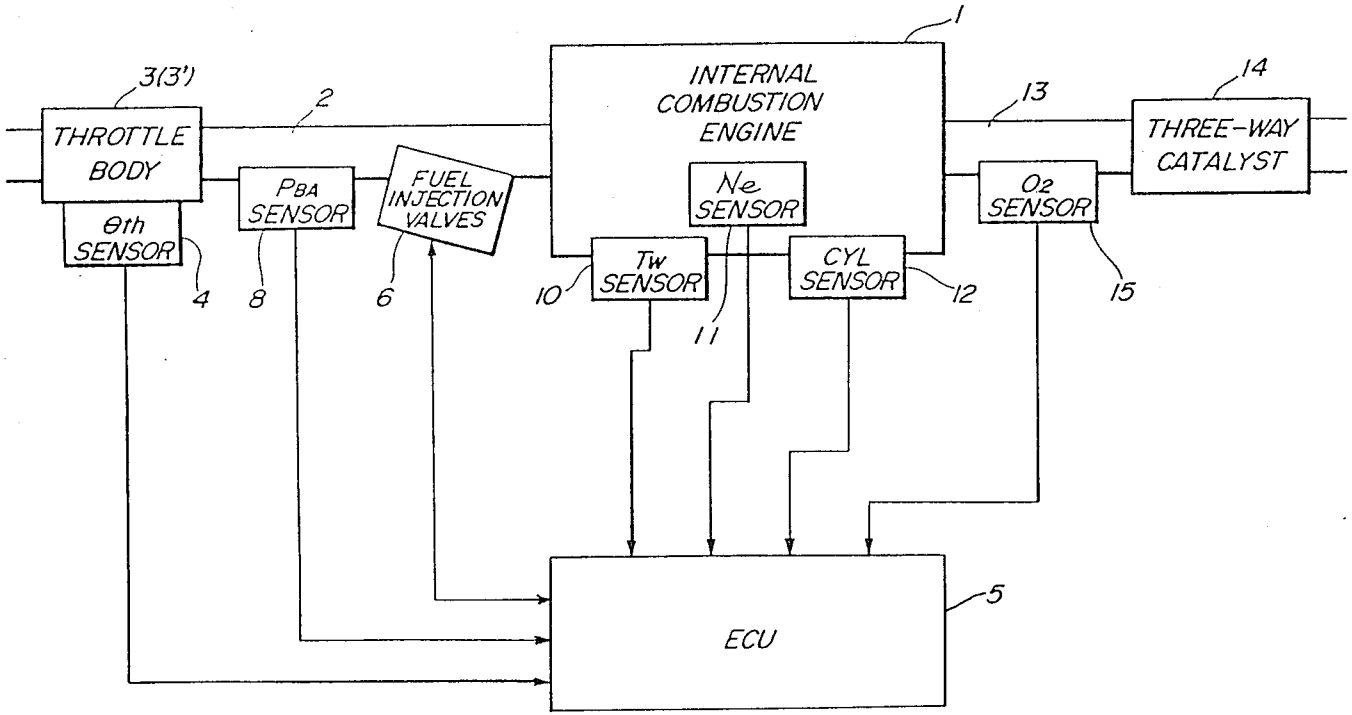
FIG. 1 is a schematic block diagram showing the overall construction of an air-fuel ratio control system to which is applied the method according to the invention.

Referring first to FIG. 1, there is illustrated an air-fuel ratio control system to which is applied the method of the invention. In the figure, reference numeral 1 designates an internal combustion engine which may be a four-cylinder type, for instance. An intake pipe 2 is connected to the cylinder block of the engine. A throttle body 3 with a throttle valve 3' therein is arranged across the intake pipe 2. Connected to the throttle valve 3' is a throttle valve opening ($\theta$th) sensor 5, which detects the throttle valve opening $\theta$th, converts same into an electric signal, and supplies the electric signal to an electronic control unit (hereinafter called "the ECU") 5.

A fuel injection device comprised of fuel injection valves (INJ) 6 is arranged in the intake pipe 2 at locations between the engine 1 and the throttle body 3. Each of the fuel injection valves 6 is connected to a fuel pump, not shown, and also electrically connected to the ECU 5 to have it valve opening period $T_{OUT}$ controlled by a driving signal from the ECU 5.

On the other hand, an absolute pressure ($P_{BA}$) sensor 8 is connected to the intake pipe 2 at a location immediately downstream of the throttle valve 3' of the throttle body 3, which detects the absolute pressure $P_{BA}$, converts same into an electric signal, and supplies the electric signal to the ECU 5.

Mounted on the cylinder block of the engine 1 is an engine coolant temperature ($T_W$) sensor 10 which is embedded in a peripheral wall of a cylinder filled with coolant and senses the engine coolant temperature $T_W$ as a temperature representative of the engine temperature and supplies an electrically converted signal to the ECU 5.

An engine rotational speed ($N_e$) sensor 11 and a cylinder-discriminating (CYL) sensor 12 are arranged in facing relation to a camshaft of the engine or a crankshaft of same, neither of which is shown. The sensor 11 is adapted to generate a pulse as a top-dead-center (TDC) signal at one of predetermined crank angles each in advance of the top dead center position at the start of suction stroke of each cylinder whenever the crankshaft of the engine rotates through 180 degrees, and delivers the TDC signal to the ECU 6. The sensor 12 is adapted to generate a pulse as a cylinder-discriminating signal at a predetermined crank angle of a particular cylinder, and delivers the cylinder-discriminating signal to the ECU 5.

A three-way catalytic converter 14 is arranged in an exhaust pipe 13 extending from the cylinder block of the engine 1, for purifying toxic components, i.e. HC, CO, and NOx in the exhaust gases. An $O_2$ sensor 15 as an exhaust component concentration sensor is arranged in the exhaust pipe 13 at a location upstream of the three-way catalytic converter 14. The $O_2$ sensor 15 senses the concentration of oxygen in the exhaust gases and delivers an electric signal having a voltage corresponding to the difference between the sensed oxygen concentration and a predetermined reference value $V_r$ to the ECU 5. More specifically, when the oxygen concentration value exceeds the predetermined reference value $V_r$, the output from the $O_2$ sensor 15 is taken as a rich air-fuel ratio signal, and when the oxygen concentration value is below the predetermined reference value $V_r$, the $O_2$ sensor output 15 is taken as a lean air-fuel ratio signal. The rich air-fuel ratio signal and the lean air-fuel ratio signal represent an air-fuel ratio of the mixture being supplied to the engine richer than the stoichiometric ratio and one leaner than the latter, respectively.

The ECU 5 operates in response to the output signals from the above-mentioned various operating parameter sensors to calculate the fuel injection period $T_{OUT}$, i.e. the valve opening period for the fuel injection valves 6 whenever a pulse of the TDC signal is inputted thereto, by the use of the following equation:

$$T_{OUT}=T_i\times K_1\times K_{O2}+K_2 \quad (1)$$

where $T_i$ represents a basic fuel injection period or valve opening period for the fuel injection valves 6, and is read from memory means, hereinafter referred to, within the ECU 5 as a function of absolute pressure $P_{BA}$ within the intake pipe and the engine rotational speed Ne, for instance. $K_{02}$ represents an $O_2$ feedback correction coefficient according to the invention, hereinafter described in detail. $K_1$ and $K_2$ are correction coefficients and correction variables, respectively, which are set, in response to operating conditions of the engine represented by output signals from the operating parameter sensors, to optimal values for various operating characteristics of the engine such as fuel consumption and engine accelerability.

The ECU 5 supplies the fuel injection valves 6 with driving signals corresponding to the fuel injection period TOUT calculated as above to open same over the period TOUT.

Figure 2:
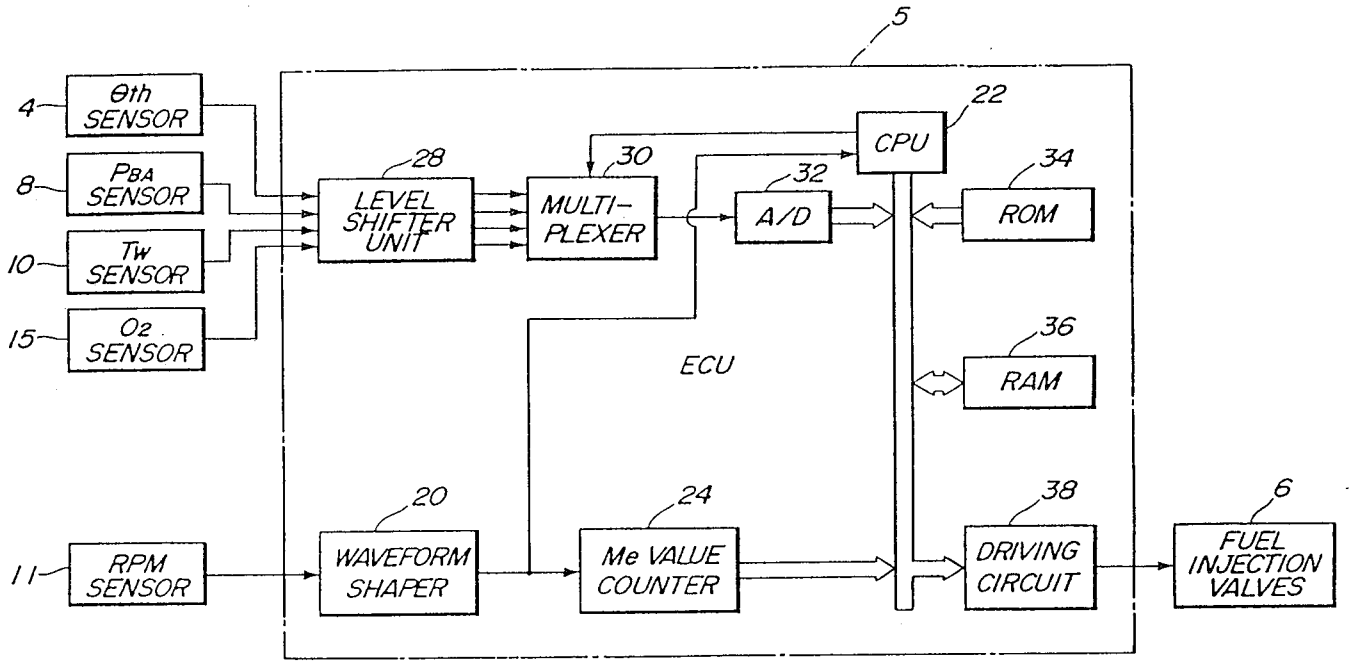
FIG. 2 is a schematic block diagram showing the internal construction of an electronic control unit appearing in FIG. 1.

FIG. 2 shows the internal arrangement of the ECU 5 in FIG. 1. An output signal from the engine rotational speed sensor 11 has its waveform shaped by a waveform shaper circuit 20, and the shaped signal is then delivered to a central processing unit (hereinafter called "the CPU") 22 as TDC signal pulses, as well as to an Me counter 24. The Me counter 24 measures the time interval between an immediately preceding pulse of the TDC signal and a present one thereof, and outputs a counted value Me which is proportional to the reciprocal of the actual engine rotational speed Ne. The counted value Me from the Me counter 24 is delivered to the CPU 22 via a data bus 26.

On the other hand, the output signals from the throttle valve opening sensor 4, the intake pipe absolute pressure sensor 8, the engine coolant sensor 10 and the $O_2$ sensor are shifted to a predetermined voltage level by a level shifter unit 28, and the level-shifted signals are successively delivered, by means of a multiplexer 30, to an A/D converter 32, which in turn converts the analog or output signals from the sensors into respective corresponding digital signals, and delivers them to the CPU 22 via the data bus 26.

Further connected to the CPU 22 are a read-only memory (ROM) 34, a random access memory (RAM) 36, and a driving circuit 38. The ROM 34 stores control programs to be executed by the CPU 22 and various data such as maps and tables for determining the basic fuel injection value $T_i$ and the correction values. The RAM 36 temporarily stores results of various calculations executed by the CPU 22.

The CPU 22 executes a control program stored within the ROM 34 to read from the ROM 34 values of correction coefficients and correction variables as well as the $T_i$ value in response to the output signals from the operating parameter sensors to calculate the valve opening period $T_{OUT}$ for the fuel injection valves 6, and delivers data of the calculated value TOUT to the driving circuit 38, which in turn delivers the driving signals to the fuel injection valves 6 to open same over the valve opening period TOUT.

Figure 3A:
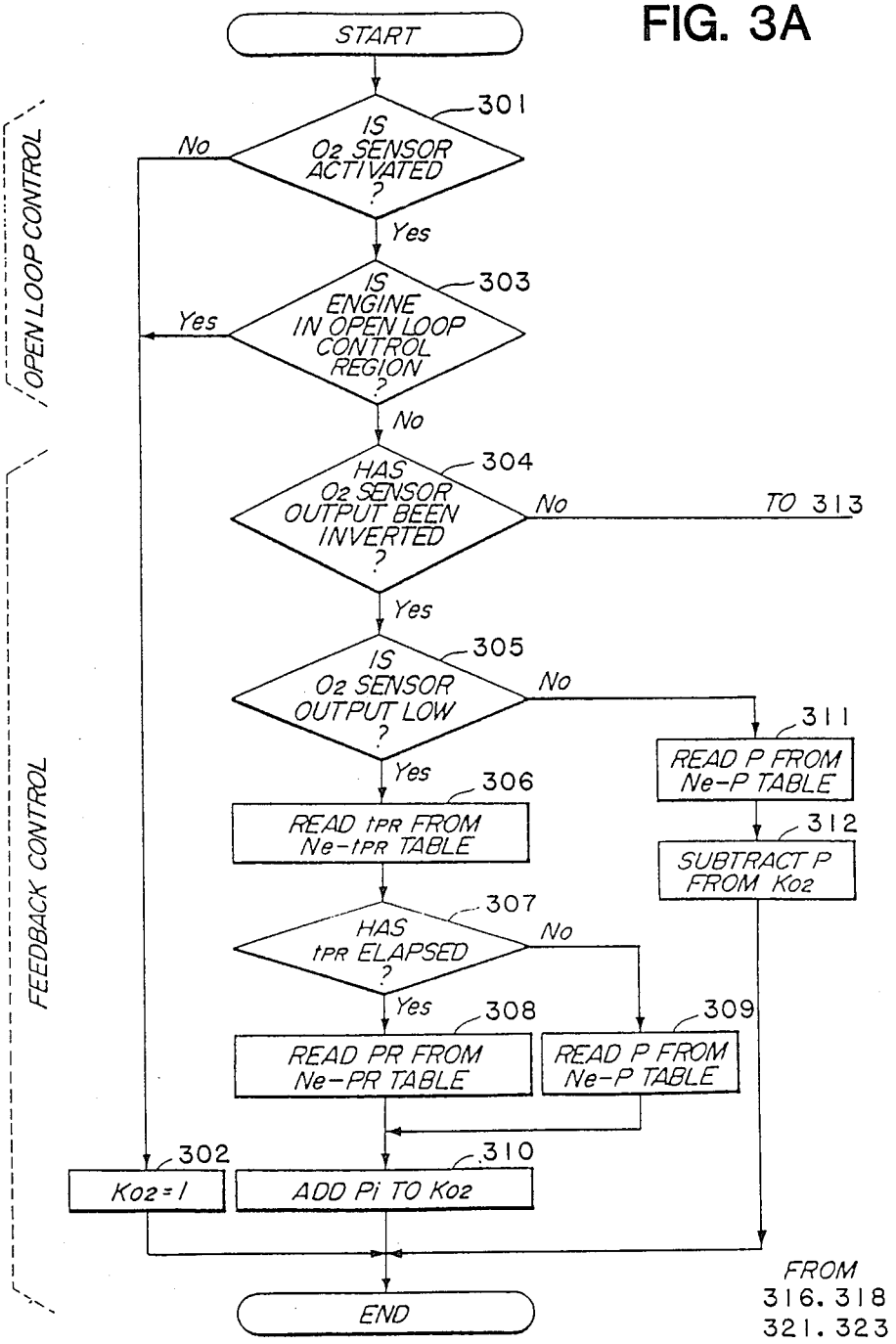
FIGS. 3, 3A, and 3B are a of a subroutine for calculating the value of a correction coefficient $KO_2$ employed in effecting the air-fuel ratio feedback control.
Figures 3, 3B:
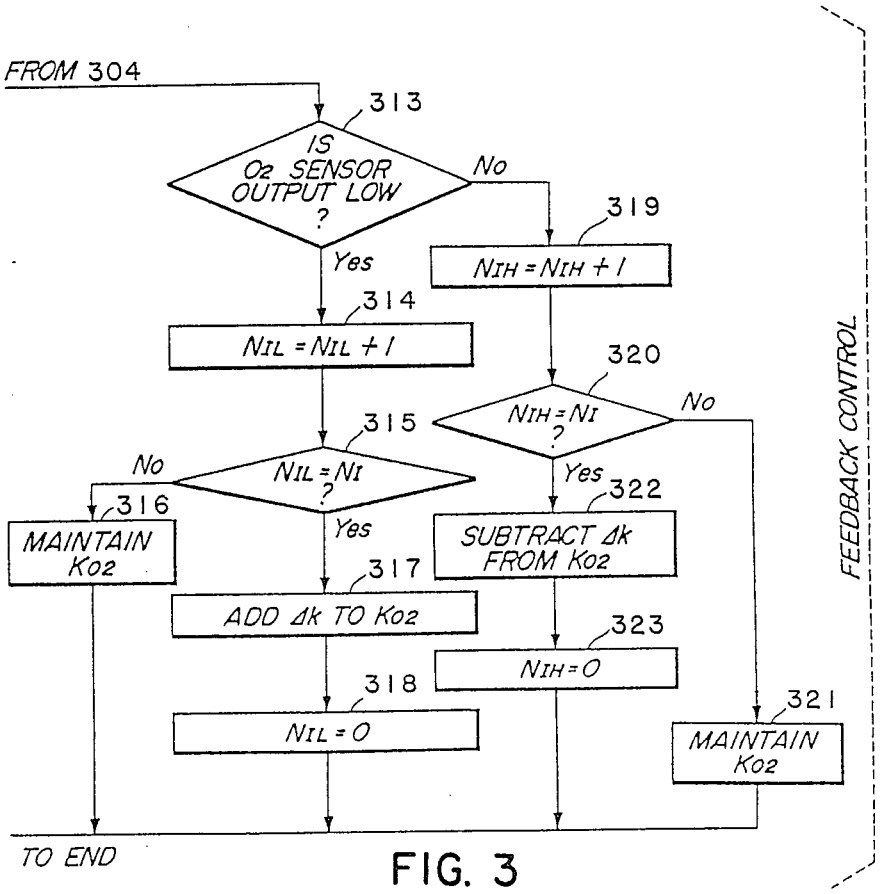

FIG. 3 shows a subroutine for calculating the value of the $O_2$ feedback correction coefficient $KO_2$, which is executed by the CPU 22 whenever a pulse of the TDC signal is inputted thereto.

First, it is determined at a step 301 whether or not the activation of the $O_2$ sensor has been completed. For example, this determination is made by an internal resistance-detecting method wherein it is detected whether or not the output voltage from the $O_2$ sensor 15 has dropped to an activation-starting point $V_x$ (e.g. 0.6 volts), and the $O_2$ sensor is judged to have been activated when the point $V_x$ has been reached. If the answer to the question of the step 301 is No, the correction coefficient $K_{02}$ is set to 1.0 at a step 302, followed by terminating the program, whereas if the answer is Yes, it is determined at a step 303 whether or not the engine 1 is operating in an open loop control region. The open loop control region includes a high engine load (WOT) region, a low engine speed region, a high engine speed region, and a mixture-leaning region, for example.

If the answer to the question of the step 303 is Yes, the coefficient $K_{02}$ is set to 1.0 at the step 302, followed by terminating the program. Then, the correction coefficients $K_1$ and correction variables $K_2$ are set to respective values corresponding to an operating condition in which the engine is determined to be operating, thus effecting open loop control of the valve opening period $T_{OUT}$ using the set correction coefficients and correction variables $K_{O2}$, $K_1$, and $K_2$, as is already known.

Figure 4:
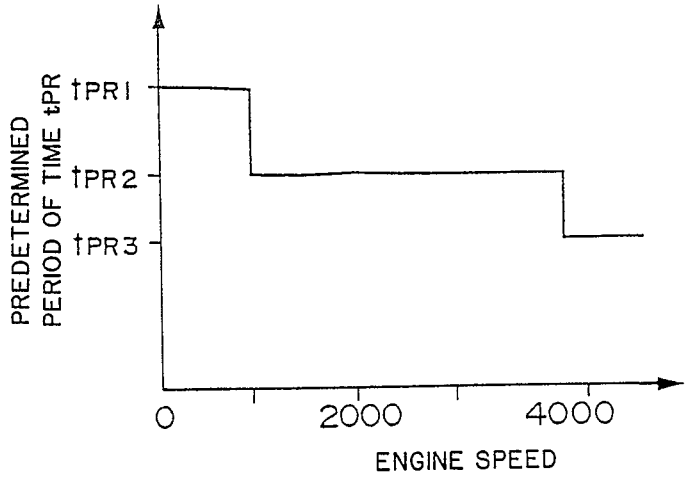
FIG. 4 is a graphic representation showing, by way of example, set values of a predetermined period of time tPR applied in effecting the feedback control.

If the answer to the question of the step 303 is No, it is assumed that the engine is in a feedback control region in which the valve opening period TOUT is to be determined by feedback control. Specifically, the program proceeds to a step 304 to determine whether or not there has been an inversion in the output level of the $O_2$ sensor 15. If the answer to the question of the step 304 is Yes, it is determined at a step 305 whether or not the output level of the $O_2$ sensor 15 is low (at which level proportional-term control (P-term control) is to be executed). Upon obtaining an affirmative answer to the step 305, the program proceeds to a step 306 wherein an $N_e$-tPR table (FIG. 4) stored in the ROM 34 in FIG. 2 is retrieved to determine a value of a predetermined period of time tPR which corresponds to the engine rotational speed Ne detected when a correction value $P_R$ (a first correction value) was applied last time. The predetermined period of time tPR is employed to apply the correction value $P_R$ with a cycle a predetermined number of times as large as the fluctuation cycle T of the output voltage of the $O_2$ sensor 15. In a preferred embodiment, the correction value $P_R$ is set to a value 1.25 times as large as the fluctuation cycle T so as to apply the correction val $P_R$ with a cycle twice as large as the fluctuation cycle T of the output voltage of the $O_2$ sensor 15. Since the fluctuating cycle T becomes shorter as the engine rotational speed Ne increases, the predetermined time period tPR is set to smaller values as the engine rotational speed Ne increases, as shown in FIG. 4, so that the cycle or time interval of application of the correction value $P_R$ is substantially constant (=2T) over the whole engine speed range. For example, the period tPR is set to values tPR1, tPR2, and tPR3 (tPR1>tPR2>tPR3), when the engine rotational speed Ne is below 1,000 rpm, between 1,000 rpm and 4,000 rpm, and above 4,000 rpm, respectively.

Figure 5:
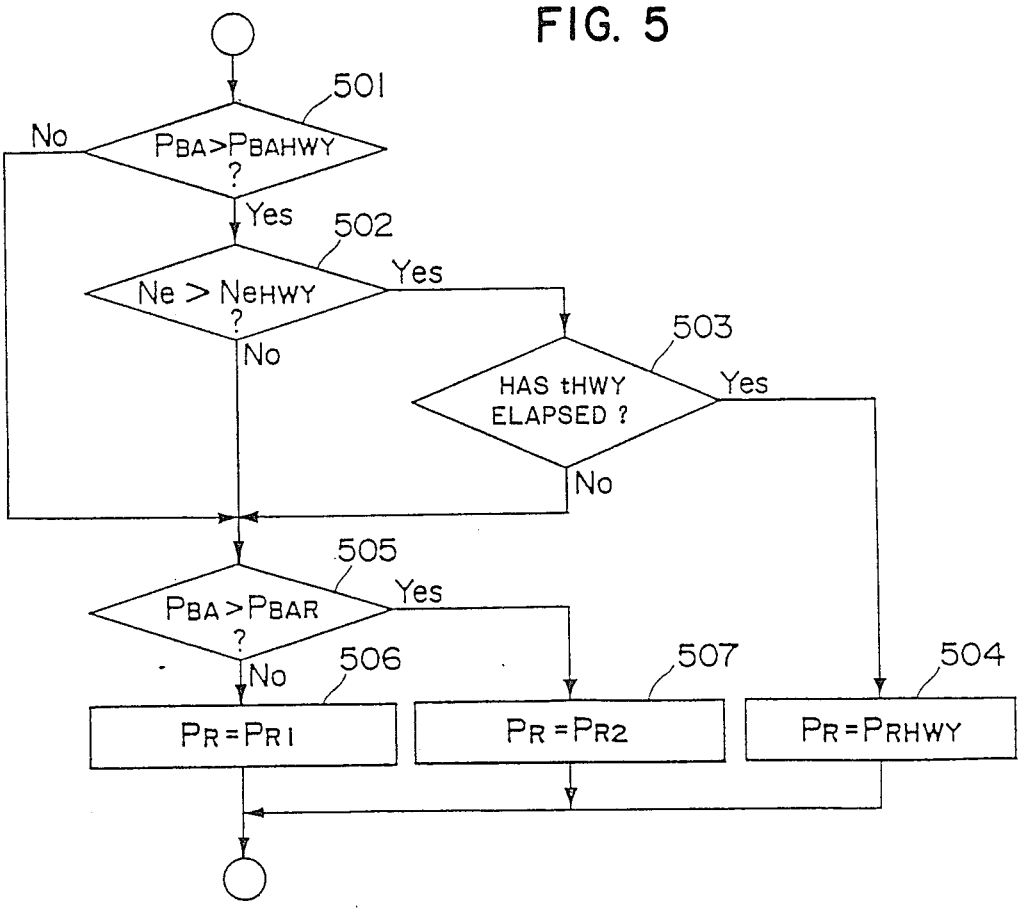
FIG. 5 is a flowchart of a subroutine for calculating the value of a correction value $P_R$ applied for proportional control, which is executed in a step 308 in FIG. 3.

After the predetermined time period tPR has thus been determined, a step 307 is executed to determine whether or not the predetermined time period tPR has elapsed since the correction value $P_R$ was applied last time. If the answer is Yes, a value of the correction value $P_R$ is determined as a function of the engine rotational speed Ne and the intake pipe absolute pressure $P_{BA}$ by a $P_R$ calculating subroutine in FIG. 5, at a step 308.

In the $P_R$ calculating subroutine, it is first determined at a step 501 whether or not the intake pipe absolute pressure $P_{BA}$ is higher than a first predetermined value $P_{BAHWY}$ (e.g. 310 mmHg). If the answer is Yes, it is determined whether or not the engine rotational speed $N_e$ is higher than a predetermined value $N_e$HWY (e.g. 2,200 rpm). If the answer is Yes, that is, the conditions $P_{BA}>P_{BAHWY}$ and $N_e>N_{eHWY}$ are fulfilled where the engine 1 is operating in a high speed/high load condition (high speed cruising), it is determined at a step 503 whether or not a predetermined period of time $t_{HWY}$ (e.g. 10 sec) has elapsed since the engine shifted to the high speed/high load condition. If the answer to the question of the step 503 is Yes, the correction value $P_R$ is set to a predetermined value $P_{RHWY}$ (e.g. 0.7) applicable in the high speed/high load condition, at a step 504. By providing the predetermined time period $t_{HWY}$, the air-fuel ratio can be controlled to a rich value only when the engine is in a steady high speed/high load condition (high speed cruising), thus avoiding the air-fuel ratio from becoming overrich at engine acceleration.

If any one of the steps 501, 502, and 503 provides a negative answer or No, that is, if the conditions $P_{BA} \leqq P_{BAHWY}$ or $N_e N_{eHWY}$ are fulfilled, or if the predetermined time period $t_{HWY}$ has not yet elapsed since the engine 1 shifted to the high speed/high load condition, it is determined at a step 505 whether or not the intake pipe absolute pressure $P_{BA}$ is higher than a second predetermined value $P_{BAR}$ (e.g. 410 mmHG) which is higher than the first predetermined value $P_{BAHWY}$. If the answer to the question of the step 505 is No, that is, if the condition $P_{BA} \leqq P_{BAR}$ is fulfilled where the engine 1 is operating in a low load condition, a step 506 is called for, where the correction value $P_R$ is set to a predetermined value $P_{R1}$ (e.g. 0.6) which is smaller than the correction value $P_{RHWY}$ for high speed/high load engine condition. If the answer to the question of the step 505 is Yes, that is, if the condition $P_{BA} > P_{BAR}$ is fulfilled where the engine is in a high load condition, a step 507 is called for, where the correction value $P_R$ is set to a predetermined value $P_{R2}$ (e.g. 0.5) for high load condition which is smaller than the correction value $P_R$ for low load condition.

Referring again to FIG. 3, after the setting of the correction value $P_R$ at the step 308, the correction value $P_i$ ($P_{RHWY}$, $P_{R1}$, or $P_{R2}$) is added to the $O_2$ feedback correction coefficient $K_{02}$ obtained in the last loop, at a step 310, followed by terminating the program.

On the other hand, if the answer to the question of the step 307 is No, that is, if the predetermined time period tPR has not elapsed after the correction value $P_R$ was applied last time, the program proceeds to a step 309 where a correction value P (a first correction value) is determined, which corresponds to the engine rotational value $N_e$, from an $N_e$-P table stored in the ROM 34, followed by executing the step 310 referred to above to add the correction value $P_i$ (=P) to the correction coefficient $K_{02}$ applied in the last loop, and then terminating the program.

If the answer to the question of the step 305 is No, that is, if the output level of the $O_2$ sensor is high or indicates a rich air-fuel ratio, the program proceedfs to a step 311 where a correction value P corresponding to the engine rotational speed $N_e$ is determined from the $N_e$-P table, followed by subtracting the correction value P thus determined from the correction coefficient $K_{O2}$ applied in the last loop, at a step 312, and then terminating the program.

As described above, the first correction value is applied in such a manner that the correction value $P_R$ is applied whenever the time period tPR elapses after the output level of the $O_2$ sensor has been inverted from a rich side to a lean side with respect to a predetermined reference value so that the air-fuel ratio should be controlled in the mixture-enriching direction, while the correction value P is applied before the time period tPR elapses after the output level of the $O_2$ sensor has been inverted from the rich side to the lean side, or when the $O_2$ sensor output level has been inverted from the lean side to the rich side so that the air-fuel ratio should be controlled in the mixture-leaning direction. Further, as stated before, when the engine 1 is operating in a high load condition, the correction value $P_R$ is set to a smaller value $P_{R2}$ than a value $P_{R1}$ applied when the engine 1 is operating in a small load condition ($P_{R2} < P_{R1}$). Therefore, the air-fuel ratio is shifted toward the lean side, thereby preventing the mixture from becoming rich when the engine is operated in the high load condition such as acceleration, and hence reducing the amounts of CO and HC in the exhaust gases.

Moreover, when the engine 1 is continuously operating in a high speed/high load condition, the correction value $P_R$ is set to the maximum value $P_{RHWY}$ so that the air-fuel ratio is shifted toward the rich side, thereby preventing the mixture from becoming lean due to operation of the engine in the high speed/high load condition, and hence reducing the amount of NOx in the exhaust gases.

The amounts by which the air-fuel ratio is to be shifted toward the lean side and toward the rich side may be selected to any desired values by appropriately setting the values of the correction values $P_R$, P and the frequency of application of the correction value $P_R$.

If the answer to the question of the step 304 is No, that is, if the output level of the $O_2$ sensor 15 remains on the same side with respect to the predetermined reference value, integral control (I-term control) is executed. Specifically, it is determined at a step 313 whether or not the output level of the $O_2$ sensor is low, as in the step 305. If the answer is Yes, 1 is added to a counted number $N_{IL}$ obtained in the last loop, at a step 314, thus counting the number of TDC signal pulses. Then, it is determined at a step 315 whether or not the counted number $N_{IL}$ has reached a predetermined value $N_I$. If the answer to the question of the step 315 is No, the correction coefficient $K_{02}$ is held at a value obtained in the last loop, at a step 316, whereas if the answer is Yes, a predetermined value $\Delta k$ (second correction value) is added to the correction coefficient $K_{02}$ at a step 317. Then, the counted number or pulse number $N_{IL}$ is reset to 0 at a step 316, followed by termination of the program. In this way, whenever the counted number $N_{IL}$ reaches the predetermined value $N_I$, the predetermined value $\Delta k$ is added to the correction coefficient $K_{O2}$.

On the other hand, so long as the answer to the question of the step 313 is No, the number of TDC signal pulses is counted at a step 319, followed by determining whether or not the counted number $N_{IH}$ has reached the predetermined value $N_I$, at a step 320. If the answer is No, the correction coefficient $K_{02}$ is held at a value obtained in the last loop, at a step 321, whereas if the answer is Yes, the predetermined value $\Delta k$ is subtracted from the value $K_{02}$ at a step 322, followed by resetting the counted pulse number $N_{IH}$ to 0 at a step 323 and termination of the program. In this way, whenever the counted number $N_{IH}$ reaches the predetermined value $N_I$, the predetermined value $\Delta k$ is subtracted from the coefficient $K_{O2}$.

Although in the foregoing embodiment the first correction value is set to different values depending upon the load condition of the engine as well as upon the direction of inversion of the $O_2$ sensor output level, this is not limitative to the invention, but the second correction value alone or both the first and second correction values may be set to different values depending upon the load condition of the engine as well as upon the direction of inversion of the $O_2$ sensor output level. For example, if the second correction value is set to a smaller value in correcting the air-fuel ratio to the rich side, the air-fuel ratio will remain on the lean side for a longer time period, so that the mixture will assume a leaner value, whereas if the second correction value is set to a larger value in correcting the air-fuel ratio to the rich side, the mixture will assume a richer value, thus obtaining similar results to those obtained in the case where the first correction value is set depending upon the engine load condition as well as upon the direction of inversion of the $O_2$ sensor output level.

Figure 6:
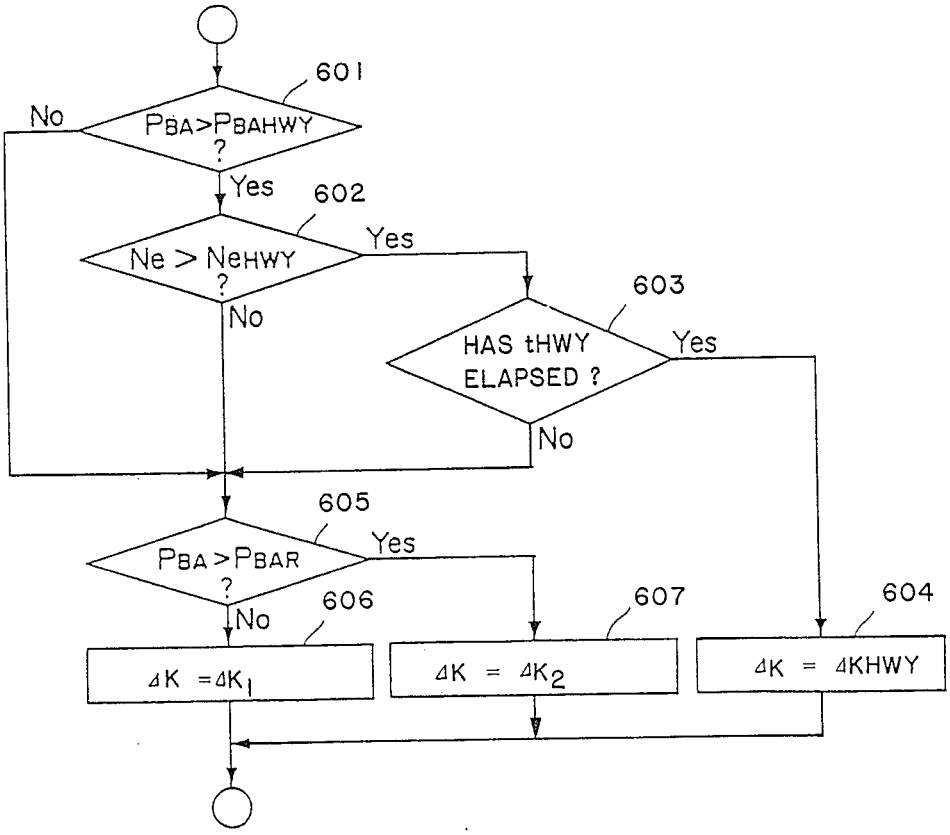
FIG. 6 is a flowchart similar to FIG. 5 showing a subroutine for calculating the value of a correction value $\Delta k$ applied for integral control.

FIG. 6 shows an example of application of the method of the invention to setting of the second correction value. In the figure, in steps 604, 606, and 607, which correspond, respectively, to steps 504, 506, and 507 in FIG. 5, the predetermined value $\Delta k$ as the second correction value is set to $\Delta k_1$, (e.g. 0.06), $\Delta k_2$ (e.g. 0.05), and $\Delta k_{HWY}$ (e.g. 0.07), respectively. The other steps 601–603, and 605 are identical, respectively, with the steps 501–503, and 505 in FIG. 5, description of which is therefore omitted.

What is claimed is:

1. A method of controlling the air-fuel ratio of a mixture being supplied to an internal combustion engine having an exhaust system, in a feedback manner responsive to output from sensing means arranged in said exhaust system for sensing the concentration of a component in exhaust gases from said engine to produce as said output a normally fluctuating output signal indicative of the concentration of said component, the method including:

comparing the value of said output signal with a predetermined reference value; and controlling the air-fuel ratio of said mixture to a desired value by means of at least one of proportional control applying a first correction value to correct the air-fuel ratio when said output signal changes from a rich side to a lean side or vice versa with respect to said predetermined reference value, and integral control applying a second correction value to correct the air-fuel ratio whenever a predetermined period of time elapses so long as said output signal remains on the lean side or on the rich side with respect to said predetermined reference value, the method comprising the steps of:

(a) sensing load on said engine;

(b) setting at least one of said first correction value and said second correction value to a smaller first value as the sensed load on said engine is higher, and applying the set at least one correction value to correction of the air-fuel ratio of said mixture in a direction of enriching said mixture; and (c) setting said at least one correction value to a second value larger than said first value when said engine is operating in a steady condition where the sensed load on said engine is higher than a predetermined value, and applying the at least one correction value set to said second value to correction of the air-fuel ratio of said mixture in said direction of enriching said mixture.

2. A method as claimed in claim 1, including the step of sensing the rotational speed of said engine, and determining that said engine is operating in said steady condition when said engine is continually operating over a predetermined period of time in a condition where the sensed load on said engine is higher than said predetermined value and the sensed rotational speed of said engine is higher than a predetermined value.

3. A method of controlling the air-fuel ratio of a mixture being supplied to an internal combustion engine having an exhaust system, in a feedback manner responsive to output from sensing means arranged in said exhaust system for sensing the concentration of a component in exhaust gases from said engine to produce as said output a normally fluctuating output signal indicative of the concentration of said component, the method including:

setting a basic quantity of fuel to be supplied to said engine in accordance with operating conditions of said engine;

comparing the value of said output signal with a predetermined reference value; and controlling the air-fuel ratio of said mixture to a desired value by means of proportional control wherein said basic quantity of fuel is corrected by a first correction value when said output signal changes from a rich side to a lean side or vice versa with respect to said predetermined reference value, and integral control wherein said basic quantity of fuel is corrected by a second correction value whenever a predetermined period of time elapses so long as said output signal remains on the lean side or on the rich side with respect to said predetermined reference value, the method comprising the steps of:

(a) sensing load on said engine;

(b) setting at least one of said first correction value and said second correction value to a smaller first value as the sensed load on said engine is higher, and applying the set at least one correction value to correction of the air-fuel ratio of said mixture in a direction of enriching said mixture; and (c) setting said at least one correction value to a second value larger than said first value when said engine is operating in a steady condition where the sensed load on said engine is higher than a predetermined value, and applying the at least one correction value set to said second value to correction of the air-fuel ratio of said mixture in said direction of enriching said mixture.

4. A method as claimed in claim 3, including the step of sensing the rotational speed of said engine, and determining that said engine is operating in said steady condition when said engine is continually operating over a predetermined period of time in a condition where the sensed load on said engine is higher than said predetermined value and the sensed rotational speed of said engine is higher than a predetermined value.

5. A method as claimed in claim 3, wherein said first correction value is a coefficient by which said basic quantity of fuel is multiplied.

6. A method as claimed in claim 3, wherein said second correction value is a variable which is added to or subtracted from said basic quantity of fuel.

* * * * *